US005488336A

United States Patent [19]

Rivera et al.

[11] Patent Number: 5,488,336

[45] Date of Patent: Jan. 30, 1996

[54] BROADBAND WAVEGUIDE PRESSURE WINDOW

[75] Inventors: David F. Rivera, Westerly, R.I.; Thomas R. Floyd, Waterford; Michael J. Josypenko, Norwich, both of Conn.

[73] Assignee: The United States of America as represented by the Secretary of the Navy, Washington, D.C.

[21] Appl. No.: 287,026

[22] Filed: Aug. 8, 1994

[51] Int. Cl.[6] ..... H01P 1/08

[52] U.S. Cl. ..... 333/252; 333/33

[58] Field of Search ..... 333/33, 252

[56] References Cited

U.S. PATENT DOCUMENTS 4,688,009 8/1987 Ferguson et al. ..... 333/252

FOREIGN PATENT DOCUMENTS 203001 10/1985 Japan ..... 333/252

295501 11/1989 Japan ..... 333/252

*Primary Examiner*—Paul Gensler

*Attorney, Agent, or Firm*—Michael J. McGowan; Prithvi C. Lall; Michael F. Oglo

[57] ABSTRACT

A broad passband pressure barrier arrangement is provided for insertion in a circular waveguide between a source and a receiver of radio frequency (RF) energy with a spatially circumferential electric field characteristic of the $TE_{01}$ mode. At least two cylindrical barrier regions are coaxially aligned and arranged symmetrically in mirror image fashion about a radial plane of the circular waveguide. The cylindrical barrier regions include at least one solid cylindrical plug region sealed in a cross-section of the circular waveguide and having a longitudinal thickness sufficient to withstand a predetermined pressure load. Each of the cylindrical barrier regions are defined by a characteristic impedance at opposing end faces thereof and a by characteristic impedance between the opposing end faces. A region-by-region impedance analysis process begins with an end face of the arrangement that is furthest from the source and is completed with an end face of the arrangement that is nearest the source. The permittivities of the barrier regions and the longitudinal thicknesses of barrier regions are optimized across the passband of interest.

3 Claims, 2 Drawing Sheets

BROADBAND WAVEGUIDE PRESSURE WINDOW

STATEMENT OF GOVERNMENT INTEREST

The invention described herein may be manufactured and used by or for the Government of the United States of America for Governmental purposes without the payment of any royalties thereon or therefor.

CROSS-REFERENCE TO RELATED PATENT APPLICATION

This patent application is co-pending with related patent application entitled Broadband Pressure Barrier for Circular Waveguide, Ser. No. 08/287,023 (Navy Case No. 74965) by the same inventors as this application.

BACKGROUND OF THE INVENTION (1) Field of the Invention

The present invention relates generally to pressure barriers for circular waveguides, and more particularly to a broadband pressure barrier for circular waveguides capable of electromagnetically passing a broad passband of radio frequency energy while also serving as a mechanical sealing barrier.

(2) Description of the Prior Art

In underwater waveguides, pressure barriers must mechanically block the passage of water when flooded while allowing electromagnetic energy to pass therethrough with minimal reflection when in the dry state. The dimensions of the barrier (i.e., its thickness) and the type of material used determines the mechanical, or hydrostatic pressure blocking ability. There are a number of materials that can be used for this purpose. In most cases, however, electrical characteristics and mechanical characteristics are not compatible. For example, if a single disk barrier were placed in a circular waveguide, it would have a nominal thickness of a half-wavelength at the center of the passband of interest. If the disk has a large relative permittivity (greater than 5), the disk may be capable of passing electromagnetic energy, but the thickness of the disk may not be sufficient to withstand the expected pressure. On the other hand, a disk fabricated from a material with a low relative permittivity (less than 3) will be thicker and better able to withstand the expected pressures, but the electrical characteristics may be unsuitable for the passage of electromagnetic energy.

In the past, pressure barriers for circular waveguide applications comprised a series of cascaded disks as shown in the barrier 10 is sealed in a cylindrical waveguide 100 and consists of three cascaded disks 11, 12 and 13. Low permittivity disks 11 and 13 allow for impedance matching between the empty waveguide and high permittivity disk 12 such that barrier 10 minimizes the reflection from an impinging electromagnetic field. Disks 11 and 13 are nominally a quarter-wave thick (measured with respect to wavelength in waveguide 100) at the center of the passband of operation. This arrangement can meet the requirement of low reflection and resistance to collapse under high hydrostatic pressure if the center or high-permittivity disk 12 is mechanically capable of doing so. The difficulty in this arrangement is that low permittivity disks 11 and 13 must be manually tuned so that reflection is minimized. This is performed by manually grinding or lapping the disks, and assembling the barrier to check the voltage standing wave ratio (VSWR), from which the reflection coefficient is computed. If the VSWR is not within specified limits, the barrier is disassembled, and the tuning process is repeated—a time consuming and expensive procedure.

Another pressure barrier design offering low reflection to an incident propagating field is shown in the axial cross-section of FIG. 2 where two pressure barrier disks 20 and 21 are inserted in circular waveguide 100. However, to be effective, tolerances between disks 20 and 21 must be kept on the order of 0.0002 to 0.0005 inches. This makes the barrier manufacturing process difficult and expensive. If a small VSWR is required, more disks are cascaded in a similar spaced apart fashion. The disks can differ in permittivity and can be spaced to yield a minimum VSWR across the band of interest. Although effective in reducing the VSWR, spacing tolerances increase the level of complexity. Another problem associated with the multiple disk system is that the relative permittivities of the disks can vary thereby adding a design parameter to be considered.

U.S. Pat. No. 3,439,296 is an example of a multiple disk system. A dielectric structure formed by a pair of axially spaced dielectric plates is sealed across a waveguide. An inductive iris structure having a diameter smaller than the waveguide diameter is disposed between the plates. Such iris structures suppress extraneous electromagnetic waveguide modes (i.e. "ghost modes") that are evanescent in the vicinity of a microwave window structure. (The ghost mode fields have a detrimental effect on the high-power handling ability of the disk.) The iris structure alters the radius of the waveguide, making a waveguide carrying the non-dominant $TE_{01}$ mode subject to mode conversion.

It is further known in the prior art to thin or thicken a dielectric disk along longitudinal regions thereof where the electric field is at its maximum intensity. For example, in U.S. Pat. No. 3,594,667, the dielectric disk is altered in a fashion that improves the high-power operating bandwidth of the disk. The thickness of the dielectric material or the dielectric constant of the window member are varied as a function of the distance from the center of the window. The objectives of the alterations are met by tuning out "ghost modes" in the dielectric region. The extent of the alterations is arrived from a knowledge of the electric field configuration possessed by the "ghost modes".

SUMMARY OF THE INVENTION

Accordingly, it is an object of the present invention to provide a pressure barrier arrangement, and method for designing same, to pass a broadband radio frequency (RF) signal through a circular waveguide while simultaneously serving as a mechanical obstruction to the passing of a pressurized fluid such as water should water enter the waveguide.

Another object of the present invention is to provide a pressure barrier arrangement to pass a broadband RF signal with a spatially circumferential electric field characteristic of the $TE_{01}$ mode through a circular waveguide without conversion losses.

Still another object of the present invention is to provide a pressure barrier arrangement that may be properly sized according to a systematic method for a particular application in order to avoid trial and error sizing of the barrier arrangement.

Other objects and advantages of the present invention will become more obvious hereinafter in the specification and drawings.

In accordance with the present invention, a broad passband pressure barrier arrangement is provided for insertion in a circular waveguide between a source and a receiver of radio frequency (RF) energy with a spatially circumferential electric field. At least two cylindrical barrier region pairs, formed of dielectric materials, are coaxially aligned and arranged symmetrically in mirror image fashion about a radial plane of the circular waveguide. The cylindrical barrier region pairs include solid cylindrical plugs sealed in a cross-section of the circular waveguide. The plugs must be longitudinally thick enough to withstand a predetermined pressure load. Each mirror pair of the cylindrical barrier regions is defined by a characteristic permittivity and longitudinal thickness. A region-by-region impedance analysis process begins with an end face of the arrangement that is furthest from the source and is completed with an end face of the arrangement that is nearest the source. The permittivities and/or the longitudinal thicknesses of the barrier regions are optimized across the passband. Optimization is achieved when the input impedance of the barrier as a whole as seen from the source side is equal to the characteristic impedance of the circular waveguide over the desired RF band of interest.

BRIEF DESCRIPTION OF THE DRAWINGS

Other objects, features and advantages of the present invention will become apparent upon reference to the following description of the preferred embodiments and to the drawings, wherein.

DESCRIPTION OF THE PREFERRED EMBODIMENTS

Figure 1:
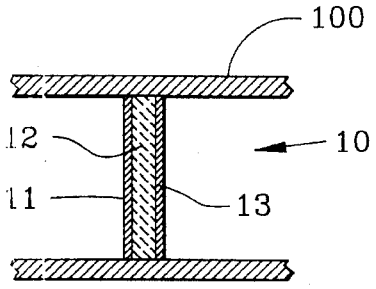
FIG. 1 (PRIOR ART)
FIG. 1 is an axial cross-section of a prior art cascaded disk pressure barrier arrangement for a circular waveguide.
Figure 2:
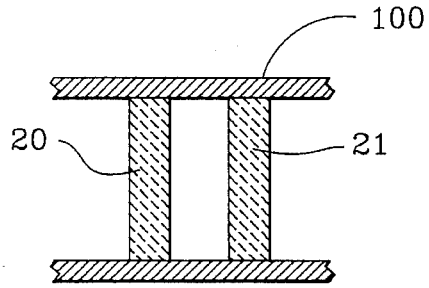
FIG. 2 (PRIOR ART)
FIG. 2 is an axial cross-section of a prior art spaced-apart disk pressure barrier arrangement for a circular waveguide.
Figure 3:
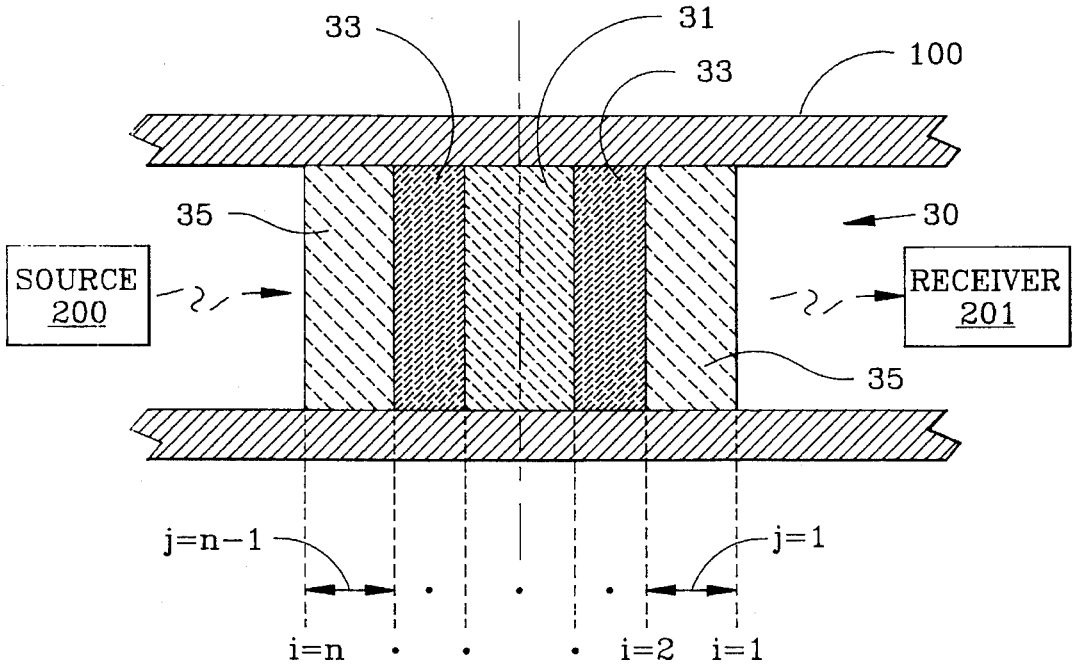
FIG. 3 is an axial cross-section of a preferred embodiment pressure barrier according to the present invention.

Referring now to the drawings, and more particularly to FIG. 3, an axial cross-section of a preferred embodiment pressure barrier 30 is shown installed in a circular waveguide 100. As shown, pressure barrier 30 consists of a solid, cylindrical dielectric central barrier region 31 and two pairs of solid, cylindrical dielectric regions 33 and 35 abutting central region 31. Central region 31 can be thought of as a mirror pair of dielectric regions each one-half the width of central region 31 and joined at the radial plane of symmetry. Alternatively, depending on the bandwidth of interest, only two pairs (smaller bandwidths) or four or more pairs (larger bandwidths) of barrier regions may be provided. Central region 31 and region pairs 33 and 35 are fabricated from different dielectric materials and have different thicknesses. Regions 31, 33 and 35 are sealed in place against the inside walls of waveguide 100. Typically, soldering or brazing processes well known in the art are employed such that the only obstruction seen by an electric field propagating from source 200 (e.g., transmitter) to receiver 201 (e.g., antenna) is pressure barrier 30.

Pressure barrier 30 is designed to minimize reflection of an electric field propagating through circular waveguide 100 in a spatially circumferential pattern as displayed, for example, by the $TE_{01}$ mode. In some present applications (frequency range: 43.5 GHz–45.5 GHz), circular waveguide 100 connects a source 200 to a receiver 201 and operates in the $TE_{01}$ mode. Accordingly, the design of pressure barrier 30 will be discussed as it relates to this mode. However, the pressure barrier design and technique for sizing same presented herein can be extended to any mode and waveguide cross-section, so long as the mathematical expressions describing the wave propagation in the waveguide are known.

Pressure barrier 30 is designed in a manner such that its characteristics (e.g., its permittivity and/or thickness of each region or region pair) yield the lowest possible VSWR over the passband of interest. Optimum dimensions of pressure barrier 30 are computed using a minimization technique such as the method of steepest descent. However, it is to be understood that other optimization methods may be utilized.

The required operating bandwidth of pressure barrier 30 is provided for by matching the wave impedance of waveguide 100 preceding and following pressure barrier 30. Each region behaves as a frequency dependent tuner by altering the electromagnetic wave's velocity in each of the regions. The $TE_{01}$ mode is not a dominant mode and is susceptible to mode conversion. Accordingly, design of the pressure barrier in the present invention uses the propagation constant $\beta$ to properly gauge the wave's behavior as it passes through pressure barrier 30.

Optimization of the permittivity and thickness of central region 31 and region pairs 33 and 35, is accomplished in accordance with a region-by-region impedance analysis process using the propagation constant $\beta$. This process starts with the region nearest receiver 201 and finishes with the region nearest source 200. The sizing process is carried out region-by-region for the whole of barrier 30. Then, when the input impedance viewed from the end boundary (i=n) facing source 200 is equal to the characteristic impedance of waveguide 100 over a substantial portion of the RF passband, the reflection back to source 200 is minimized. This condition is representative of a VSWR close to unity over the passband. The process is repeated over a variety of frequencies in the passband of interest.

To perform the impedance analysis process, pressure barrier 30 is viewed in terms of n boundaries and (n−1) regions as shown in FIG. 3. The process begins with the knowledge that the characteristic impedance $Z_c$ in the waveguide region between pressure barrier 30 and receiver 201 is equal to the characteristic impedance of the transmission medium (e.g., air) or $Z_{c(air)}$. Using this fact, the characteristic impedance for each i-th barrier and j-th region can be successively evaluated in a stepwise process that progresses along barrier 30 from the end nearest receiver 201 to the end nearest source 200.

The input impedance at each i-th boundary or $Z_{in(i)}$ is based on the transmission line formula $$Z_{in(i)} = Z_{c(j)} \frac{Z_{L(i-1)} + Z_{c(j)}\tanh(\gamma_{(j)}t_{(j)})}{Z_{c(j)} + Z_{L(i-1)}\tanh(\gamma_{(j)}t_{(j)})} \quad (1)$$

where $Z_c(j)=k_0Z_0/\beta_j$, $k_0$ being the wave number $2\pi f/v$ (f being the frequency and v being equal to the speed of light) in free space, $Z_0$ being the wave impedance of free space ($\cong$376.7 $\Omega$), and $\beta_j$ being the complex portion of the propagation constant $\gamma$ for the j-th region.

$Z_{L(i-1)}$ is the load impedance viewed by the previous boundary (i.e., next successive boundary in the direction of receiver 201);

$\gamma_{(j)}$ is the complex propagation constant for the j-th region; and $t_{(j)}$ is the thickness of the j-th region.

For the complex propagation constant $$\gamma = \alpha^c + \alpha_j^d + \sqrt{-1}\ \beta_j$$

$\alpha^c$ is the attenuation due to finitely conducting metal walls, and $\alpha_j^d$ is the attenuation constant of the j-th disk due to the presence of a dielectric having a high loss tangent. For the $TE_{01}$ mode, $$\alpha^c = \frac{1}{bZ_0}\sqrt{\frac{\omega\mu_0}{2\sigma}}\ \frac{x^2}{\sqrt{1-x^2}} \tag{3}$$

where b is the inside radius of waveguide 100;

$\omega$ is the angular frequency $2\pi f$;

$\mu_0$ is the permeability of free space ($4\pi\times10^{-7}$ Henry/meter (H/m));

$\sigma$ is the conductivity of the material used to construct waveguide 100; and $x=k_c/k_0$, $k_c$ being the cutoff number of waveguide 100 that is equal to $P'_{01}/b$, $P'_{01}$ being a constant (3.83171) for the $TE_{01}$ mode. Also, $$\alpha_j^d \approx \frac{1}{2}\cdot\frac{k_0^2\epsilon_{rj}\tan\delta}{\sqrt{k_0^2\epsilon_{rj}-k_c^2}} \tag{4}$$

for low loss tangents (i.e., $\tan\delta \leqq 0.1$), where $\epsilon_{rj}$ is the relative permittivity of the j-th disk.

$\beta_j$ is the complex portion of the propagation constant. For the j-th dielectric disk having the same diameter as the interior of the waveguide, $$\beta_j = \sqrt{k_0^2\epsilon_{rj}-k_c^2} \tag{5}$$

and is equal to the phase shift in the j-th disk.

In order to initiate the analysis or design process, a barrier material and thickness is selected based on the mechanical pressure load requirements. The passband of interest, type of transmission line, type of source and the desired VSWR will ultimately determine the number of total regions that must be used/optimally sized by the present invention. Further, each of the regions must be assigned initial value "guesses" in terms of either permittivity or thickness. Finally, the center frequency of the passband of interest is generally selected as the first frequency to be optimized.

Once $\gamma_{(j)}$ is determined for the region nearest receiver 201, equation (1) for $Z_{in(i)}$ can be solved. Note that the first time through, $Z_{L(i=1)}$ is equal to $Z_{c(air)}$. For each frequency, the permittivity and/or thickness of each region are optimized throughout the stepwise process (e.g., by the method of steepest descent) so that at the boundary i=n, $Z_{in(i)} \approx Z_{c(air)}$. This is the optimal condition that yields a VSWR of 1 since $$VSWR = \frac{1+|\rho_n|}{1-|\rho_n|} \tag{6}$$

where $|\rho_n|$ is the magnitude of the reflection coefficient. The complex reflection coefficient $\rho_n$ is computed from $$\rho_n = \frac{Z_{(in(n)} - Z_{c(air)}}{Z_{in(n)} + Z_{x(air)}} \tag{7}$$

where $Z_{in(n)}$ is the n-th boundary input impedance, and $Z_{c(air)}$ is the characteristic impedance of the empty guide.

The pressure barrier designed and optimized in the above described fashion behaves as a tuned circuit. It will offer a high degree of reflection outside the radio frequency band of interest, and allow the traversal of electromagnetic energy with minimal (or negligible) reflection in the passband. It is also a mechanical obstruction. If made from mechanically strong materials, it blocks water thereby protecting a transmitting source from sea water damage. The strengths of the materials determine the ultimate hydrostatic pressure for a given operational (tactical) specification.

The pressure barrier matches the characteristic impedance of the air or gas-filled waveguides joined on either side of the barrier. Each dielectric disk acts as a transmission line which, through its length, or thickness, changes or transforms the impedance at the point where the neighboring dielectric disk begins. The characteristic impedance, which is highly frequency-dependent in the present case, is controlled by the permittivity and thickness of the dielectric disk. The end result is a pressure barrier that is frequency-dependent, allowing greater flexibility in impedance matching. When cascaded with other dielectric disks, it is possible to have an impedance match over a broad range of frequencies.

The advantages of the present invention are numerous. Each dielectric disk is the full size of the interior diameter of the waveguide thus minimizing mode conversion in $TE_{01}$ circular waveguides. The full size disks form a pressure barrier that offers a high mechanical strength over a broad range of frequencies. Once the design parameters are optimized for a particular application, the dielectric disks are easily constructed by molding or turning on a lathe, with no manual trial and error grinding or lapping of the disks. In low-power applications (i.e., less than or equal to 30 watts), the pressure barrier may be made from a low power plastic such as compounds of polyphenylene oxide and polystyrene (e.g., Noryl), polyethylene, polystyrene, acrylic (e.g., plexiglas), polycarbonate resin (e.g., Lexan), cross-linked polystyrene (e.g., Rexolite) or any other plastic that has a low loss tangent. For medium and high-power applications (i.e., greater than 30 watts), the pressure barrier may be made from a glass (e.g., fused silica or quartz) or ceramic (e.g., beryllium oxide or aluminum nitride) that has a high mechanical strength and a low loss tangent.

Figure 4:
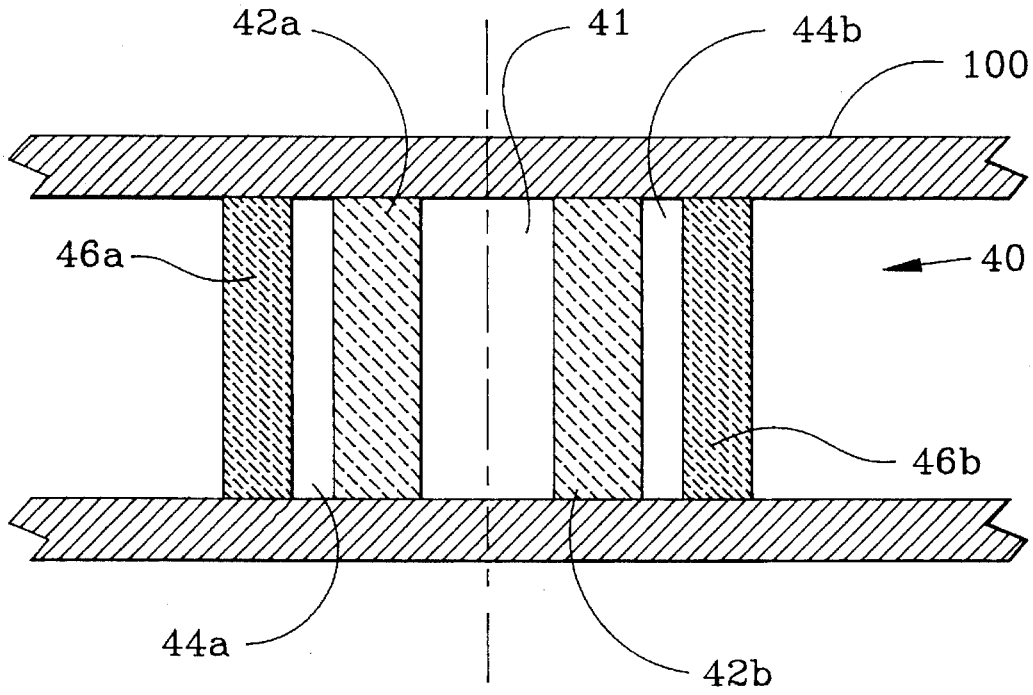
FIG. 4 is an alternative embodiment pressure barrier according to the present invention.

While the present invention has been described relative to a particular embodiment its teachings are not so limited. For example, the number of pairs of dielectric disks can be increased or decreased depending on bandwidth requirements. In addition, although the preferred embodiment has one central region and two pairs of disks that extend therefrom in mirror image fashion, this need not be the case. One alternative embodiment pressure barrier 40 is shown in FIG. 4 where the central region 41 is an air gap with three mirror image pairs of disks, 42*a* and 42*b*, 44*a* and 44*b*, and 46*a* and 46*b*. The permittivities of the mirror image pairs can be chosen to be any value, including air, as indicated by mirror image pair 44*a* and 44*b*. Additional mirror image pairs may be added to pressure barrier 40 as long as a mirror image symmetry is maintained about the radial plane or central region 41.

The embodiment of FIG. 4 is advantageous where waveguide 100 is separable at the location of air gap 41 to allow replacement of either disks 42*a*, 44*a* and 46*a*, or 42*b*, 44*b* and 46*b* in case of failure. An air gap could also be employed at a radial plane of symmetry between two or more barriers of the type shown in FIG. 3. Regardless of the number of regions and arrangement thereof, the impedance analysis design and optimization process described above will be applicable.

It will thus be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A broad passband pressure barrier arrangement for insertion in a circular waveguide between a source and a receiver of radio frequency (RF) energy with a spatially circumferential electric field, comprising:

a solid cylindrical plug region pair sealed in a cross-section of the waveguide for blocking the passage of a predetermined pressure load, the diameter of said plug region pair being equal to the inside diameter of said waveguide, said plug region pair centered on a radial plane of the waveguide, said radial plane passing through free air, said plug region pair consisting of identically sized cylindrical plugs formed of a dielectric material having a unique permittivity, said identical cylindrical plugs having a unique longitudinal thickness;

at least one solid cylindrical barrier region pair sealed in said cross-section of the waveguide, the diameter of said at least one barrier region pair being equal to the inside diameter of said waveguide, said at least one barrier region pair centered on and disposed symmetrically about said radial plane, said plug region pair being disposed between said radial plane and said at least one barrier region pair, said at least one barrier region pair consisting of identically sized cylindrical barriers formed of a dielectric material having a unique permittivity, said identical cylindrical barriers having a unique longitudinal thickness;

each of said plugs and barriers defined by a characteristic impedance at opposing end faces thereof and by a characteristic impedance between said opposing end faces; and each permittivity and longitudinal thickness being optimized across the passband so that an input impedance of the barrier arrangement as seen from the source is equal to a characteristic impedance of the circular waveguide.

2. An arrangement as in claim 1 wherein said plug region pair and said at least one barrier region pair are selected from the group consisting generally of plastics, glass and ceramics.

3. A broad passband pressure barrier arrangement for insertion in a circular waveguide between a source and a receiver of radio frequency (RF) energy with a spatially circumferential electric field, said pressure barrier including at least one solid cylindrical barrier region pair sealed in a cross-section of the waveguide, the diameter of said at least one barrier region pair being equal to the inside diameter of said waveguide, said at least one barrier region pair consisting of identically sized cylindrical barriers formed of a dielectric material having a unique permittivity, each pair of said identically sized cylindrical barriers having a unique longitudinal thickness, each barrier region pair coaxially aligned and arranged symmetrically in mirror image fashion about a radial plane of the circular waveguide, said radial plane passing through free air, said pressure barrier arrangement further including a solid cylindrical plug region pair sealed in the cross-section of the circular waveguide and having a longitudinal thickness sufficient to withstand a predetermined pressure load, the plug region pair consisting of identically sized cylindrical plugs formed of a dielectric material having a unique permittivity, each pair of said identically sized cylindrical plugs having a unique longitudinal thickness, said plug region pair coaxially aligned and arranged symmetrically in mirror image fashion about a radial plane of the circular waveguide, said plug region pair being disposed between said radial plane and said at least one barrier region pair, each of said cylindrical plugs and barriers being defined by a characteristic impedance at opposing end faces thereof and by a characteristic impedance between said opposing end faces, wherein:

said permittivities of said barrier and plug region pairs and said longitudinal thicknesses of said barrier and plug region pairs for the passband of interest are determined by an iterative region-by-region impedance analysis that begins with an end face of said arrangement that is furthest from the source and is completed with an end face of said arrangement that is nearest the source, said permittivities of said barrier and plug region pairs and said longitudinal thicknesses of said barrier and plug region pairs being determined for frequencies across the passband using a minimization technique within said impedance analysis, said minimization technique varying the permittivities and longitudinal thicknesses of said barrier and plug region pairs under the constraint of minimum reflection to obtain an input impedance of said barrier arrangement as seen from the source equal to a characteristic impedance of the circular waveguide.

* * * * *